US010865004B2

(12) United States Patent
Tanner

(10) Patent No.: US 10,865,004 B2
(45) Date of Patent: Dec. 15, 2020

(54) METHOD FOR WRAPPING BANDS AROUND OBJECTS, AND CORRESPONDING MACHINES

(71) Applicant: ATS-TANNER BANDING SYSTEMS AG, Zug (CH)

(72) Inventor: Alois Tanner, Fahrwangen (CH)

(73) Assignee: ATS-TANNER BANDING SYSTEMS AG, Zug (CH)

( * ) Notice: Subject to any disclaimer, the term of this patent is extended or adjusted under 35 U.S.C. 154(b) by 250 days.

(21) Appl. No.: 15/543,481

(22) PCT Filed: Jan. 7, 2016

(86) PCT No.: PCT/EP2016/050212
§ 371 (c)(1),
(2) Date: Jul. 13, 2017

(87) PCT Pub. No.: WO2016/113179
PCT Pub. Date: Jul. 21, 2016

(65) Prior Publication Data

US 2018/0022489 A1 Jan. 25, 2018

(30) Foreign Application Priority Data

Jan. 15, 2015 (EP) ..... 15000087

(51) Int. Cl.
*B65B 13/04* (2006.01)
*B65B 13/24* (2006.01)
(Continued)

(52) U.S. Cl.
CPC ..... *B65B 13/04* (2013.01); *B41J 2/32* (2013.01); *B65B 13/187* (2013.01); *B65B 13/22* (2013.01); *B65B 13/24* (2013.01); *B65B 13/32* (2013.01)

(58) Field of Classification Search
CPC ..... B65B 13/00; B65B 13/02; B65B 13/04; B65B 13/08; B65B 13/18; B65B 13/22;
(Continued)

(56) References Cited

U.S. PATENT DOCUMENTS 3,716,960 A * 2/1973 Wright ..... B65B 11/08 53/397
3,771,436 A * 11/1973 Sato ..... B29C 66/21 100/33 PB
(Continued)

FOREIGN PATENT DOCUMENTS

CH 544 694 A 1/1974
DE 33 46 598 A1 10/1984
(Continued)

OTHER PUBLICATIONS

ESPACENET machine translation of EP-0401554-A1 (Year: 1990).*
ESPACENET machine translation of EP-0178385-A1 (Year: 1986).*

*Primary Examiner* — Chelsea E Stinson
*Assistant Examiner* — Himchan Song
(74) *Attorney, Agent, or Firm* — Birch, Stewart, Kolasch & Birch, LLP

(57) ABSTRACT

In a method for wrapping a band around at least one object of at least one object, in which the at least one object is wrapped with a band, wherein the band in the form of an object-band loop is arranged around the at least one object in such a manner that at least two sections of the band are made to overlap and are connected together, wherein in an area in which the at least two band sections are made to overlap, a counter-pressure plate is introduced between the at least one object and the band, and the at least two overlapping band sections are pressed against the counter-pressure plate to connect them, prior to the introduction of the counter-pressure plate the band is passed through a band
(Continued)

guiding device and/or positioned such that a defined free space is created for introducing the counter-pressure plate.

21 Claims, 5 Drawing Sheets

(51) Int. Cl.
*B41J 2/32* (2006.01)
*B65B 13/18* (2006.01)
*B65B 13/22* (2006.01)
*B65B 13/32* (2006.01)

(58) Field of Classification Search
CPC ..... B65B 13/32; B65B 13/325; B65B 61/02; B41J 2/32
USPC ..... 53/399, 411, 586, 131.2
See application file for complete search history.

(56) References Cited

U.S. PATENT DOCUMENTS 5,189,865 A * 3/1993 Andrade ..... B65B 11/08 53/228
6,186,326 B1 * 2/2001 Pienta ..... B65B 25/148 206/398
6,829,876 B1 * 12/2004 Young ..... B65B 61/06 53/410
2009/0038264 A1 * 2/2009 Redaelli ..... B65B 11/28 53/74

FOREIGN PATENT DOCUMENTS

DE 3346598 A1 * 10/1984 ..... B65B 13/325
DE 39 29 710 A1 3/1991
DE 3929710 A1 * 3/1991 ..... B29C 65/08
DE 9418542 U1 * 1/1995
DE 94 18 542.5 U1 3/1995
EP 0178385 A1 * 4/1986 ..... B65B 13/08
EP 0 401 554 A1 12/1990
EP 0401554 A1 * 12/1990 ..... B65B 13/18
WO WO 92/15486 A1 9/1992

* cited by examiner

METHOD FOR WRAPPING BANDS AROUND OBJECTS, AND CORRESPONDING MACHINES

TECHNICAL FIELD

The invention relates to a method for wrapping a band around at least one object, and in which the at least one object is wrapped with a band, wherein the band in the form of an object-band loop is arranged around the at least one object in such a manner that at least two sections of the band are made to overlap and are connected together, wherein in an area in which the at least two band sections are made to overlap, a counter-pressure plate is introduced between the at least one object and the band, and the at least two overlapping band sections are pressed against the counter-pressure plate to connect them.

Furthermore the invention relates to a device for introducing a counter-pressure plate between a band and an object that is located on a conveyor level and a machine that uses this device and can execute the process according to the invention.

PRIOR ART

In packaging technology, when objects or articles are surrounded or bundled with a band, one usually speaks of banding or strapping. In banding, the band typically consists of paper or plastic and is carried around the object to be banded in special banding machines and connected, e.g., by welding. If, in banding, the band is placed around the objects or articles to be banded in their conveying direction, the term of longitudinal banding is used.

Strapping is performed analogously, but with stronger bands and higher tensions. If during strapping the band is placed around the objects or articles to be strapped in the conveying direction, the term longitudinal strapping is used.

Both banding and strapping are methods for wrapping bands around objects. The term "wrapping bands around objects" is to be understood as meaning that one or more bands are placed around one or more objects and connected. The word "wrapping" in this process does not make any statement about band tension, but only designates the position of the band or bands with regard to the object or objects.

In the case of strapping, the bands are also often designated as straps or strapping means. In this text, unless stated otherwise, the word "band" will be understood in a general sense, and comprises both bands that can be used for banding and those that can be used for strapping.

Documents WO 92/15486, G 94 18 542.5 U1 and DE 39 29 710 C2 (Mosca) describe longitudinal strapping machines and corresponding methods: In this process the beginning of the band is held by a rear holding device below the conveyor level and extends from there to a band guide above the conveyor level. An object that moves along a conveying direction on the conveyor level makes this band protrude, so that the band is finally located on three sides of the object. The band guide then guides the band behind the object below the conveyor level.

While the object is still moving, a counter-pressure plate is introduced between the object and the band and the band is then pressed against the counter-pressure plate using a front holding device and thus held tight. The beginning of the band is released by the rear holding device and pressed by a band start holding device at a rear position against the counter-pressure plate. When the band guide now holds the band below the conveyor level, it is grasped by a loop puller and brought as a loop into the region between the front holding device and the band start holding device. The rear holding device engages with the loop and holds the band in the lower part.

An additional holding device, which here is a clamp, consisting of the rear holding device and a second clamp part, holds the upper part of the loop tightly. The loop is cut open and pulled straight through the loop puller. The beginning and end of the band are now superimposed on one another and are welded together. The counter-pressure plate generates the necessary counter-pressure under these conditions. In one embodiment the loop is not cut open, but is welded together as a loop.

EP 0 401 554 A1 (Büttner) also describes a longitudinal banding machine. Whereas the band is placed around the object in a method very similar to that in the aforementioned documents, the band control in the fastening area differs. In EP 0 401 554 A1 a gripper assumes a central role. This moves distinctly more often and must move longer distances than the holding devices in the above-mentioned documents. In this process the gripper must repeatedly rotate around itself to prevent the band from winding around the gripper.

A counter-pressure plate is used in all known methods. This plate must be movable and be placed between the band and the object and be able to be removed again from there. The removal is fairly unproblematic, since the band is already welded at the time and, along with the tension, has a certain stability. On the other hand, collision of the band with the counter-pressure plate during insertion must be avoided. A loosely clamped band can twist or fall out of the guide in the case of contact with the counter-pressure plate in this process step. A highly tensioned band risks becoming damaged or destroyed.

In the documents cited, the counter-pressure plate is inserted at a point in time at which there is a distance between the object and the band, specifically when the gripper respectively the rear holding device are far back and below the object. The band, which is drawn along by the object to be wrapped by the band, preferably to be banded and/or strapped, thus travels from the front, lower edge of the object or from the front edge of an opening in the conveyor table obliquely downward to the gripper or to the rear holding device. Thus a free space of triangular cross section forms between the band and the object. This can be used for inserting the plate.

As has been shown within the scope of the present invention, however, this method becomes problematic, for example, in the case of relatively short objects. Specifically, the counter-pressure plate should come to be located completely below the object to be wrapped by the band, preferably to be banded and/or strapped. The starting position of the gripper or rear holding device is imposed by the machine and typically, to keep the path short, it is horizontal close to the back end of the counter-pressure plate. If the front edge of an object in the position in which the object would just still cover the counter-pressure plate extends only slightly beyond the future position of the counter-pressure plate, the free space is very limited and, depending on the thickness of the counter-pressure plate, too small. Thus there is a risk that the counter-pressure plate, during its insertion, will move or even damage the band.

But even if the machine is only used for large enough objects, a free space of triangular cross section is rather unsuitable for inserting a plate of rectangular cross section. Specifically, in addition, no other holding devices, joining devices or other components may be present in this free space. Since the rectangular cross section must be fairly large compared with the theoretically necessary rectangular cross section, individual components must travel considerably longer distances than would theoretically be necessary, and under certain circumstances the machine must be designed to have larger dimensions than actually necessary.

In addition, especially in the case of very thin bands, there is a risk that they will twist around their longitudinal axis at low band tensions.

Therefore there is still a need for improved methods for wrapping bands around objects, preferably for banding and/or strapping, and corresponding machines, preferably banding and/or strapping machines.

DISCLOSURE OF THE INVENTION

The goal of the invention is therefore to create a method belonging to the initially mentioned technical field and a device that permits rapid wrapping of one or more bands around various objects with different bands and band tensions.

The solution to the problem is defined by the features of Claim 1. According to the invention, in a method for wrapping a band around at least one object, the at least one object is surrounded by a band. In this process the band is arranged in the form of an object band loop around the at least one object in such a manner that at least two band sections are made to overlap and are connected together. In an area in which the at least two band sections are made to overlap, a counter-pressure plate is introduced between the at least one object and the band. For connection, the at least two overlapping band sections are pressed against the counter-pressure plate. The method is characterized by the fact that before the introduction of the counter-pressure plate, the band is guided and/or positioned through a band guiding device such that a defined free space for introducing the counter-pressure plate is created.

The band guiding device can systematically guide the band in the area of the counter-pressure plate. In this way a defined free space for introducing the counter-pressure plate is created. For example, such a free space may have a rectangular cross section. Free spaces with essentially triangular cross sections, such as those that exist in the prior art, can consequently be avoided. By creating a defined free space, holding devices and/or joining devices and/or additional components of the machine can be placed closer to the position of the counter-pressure plate introduced. The paths of moving parts can be optimized and thus precision and/or speed increased.

If a band guiding device is used, even if the position and the geometric shape of the object to be wrapped, preferably the object to be banded and/or strapped, is not exactly known, nevertheless the band can be placed precisely and securely around the object to be wrapped by the band. For example, according to the invention it is sufficient to determine whether the band makes contact with the band guiding device and in which position the band guiding device is located, in order to decide on the time for introducing the counter-pressure plate. On the other hand, without a band guiding device, the exact position of the object and the shape of its front side would be of determining significance for the path of the band below the conveyor level and thus also for the time of introducing the counter-pressure plate.

It is much easier to coordinate the position of the band guiding device chronologically with the movement of the counter-pressure plate than to coordinate the position of the object with the counter-pressure plate. The band guiding device and the counter-pressure plate are parts of the same machine and are independent of the objects to be wrapped, preferably to be banded and/or strapped, by the band. On the other hand, it is desirable to impose as few requirements on the objects to be wrapped, preferably to be banded and/or strapped, by the band to enable the machine to be used for a great variety of objects. If the position and shape of a large number of different objects are to be registered, sensors and evaluation mechanisms will be required, and these will complicate the device and the method.

Preferably, the method is a longitudinal banding method and/or a longitudinal strapping method. Thereby, the band is guided in the conveying direction at least partially around the object. In particular an object band loop is formed around the object at least partially by a movement of the object in a conveying direction.

The conveying direction corresponds to the direction in which the object to be wrapped, preferably to be banded or strapped, by the band moves.

A level on which the object to be wrapped by the band, preferably to be banded or strapped, is moved, is designated as the conveyor level.

Specification of the conveying direction makes it possible to define orientations: An arrow pointing in the conveying direction is to be understood here as pointing from back to front. If this arrow is represented as a number line that defines a coordinate axis in the positive direction, a first point located in front of a second point has a higher value of this coordinate. In other words, the term "front" is to be understood as a region that is located in front of a region located farther back with reference to the conveying direction. In other words, the term "back" is to be understood as a region that is located behind a region located farther ahead with reference to the conveying direction.

In a longitudinal banding device and/or a longitudinal strapping device, the object is typically moved toward the loosely tensioned band in the region between the conveyor level and a band guide above the conveyor level. In this process the band projects, for example, through an opening in the conveyor level. The band is bulged out during the movement of the object and wraps itself partially around it. In this way an object band loop is formed. Surfaces of the object which are in the wrapping region and which have (local) normal vectors pointing away from the direction of movement remain uncovered.

The wrapping region is intended to describe the three-dimensional volume in which the band can move at all during the encircling of the object. The depth of this volume is equal to the width of the band. The wrapping region is located in space such that the object band loop or the unhindered tensioned band section is located completely within. The unhindered tensioned band section forms a boundary of the wrapping region. From there, it broadens in the conveying direction. The top and bottom of the wrapping region are therefore located at the level of the upper and lower limits of the unimpeded tensioned band section. The wrapping region is not to be restricted toward the front.

Theoretically, however, it is also possible to utilize a band guiding device in a loop-banding method, in a different strapping method and/or in a different banding method.

The band guiding device is preferably movable, especially in such a manner that it can move in the conveying direction and/or perpendicular to the conveying direction. Preferably the band guiding device is movable both in the conveying direction and perpendicular to the conveying direction.

This has the advantage that the band guiding device can grasp the band in a targeted manner and move and/or align it in a predefined position. During the process steps in which the band guiding device is not needed, it can be moved into a waiting position. In this way space is created for other components, which allows a more compact design of the machine, preferably of the banding machine and/or the strapping machine. This in turn enables shorter paths and faster work cycles.

In a preferred solution for the longitudinal banding or longitudinal strapping method, the band guiding device starts at a position located above or behind and above a lower fixing point. Here, the lower fixing point is the point at which the band is held beneath the object. No band is present at this location during most of the process. Therefore the risk of a collision is ruled out. The band is moved in the conveying direction by the object. To create the contact between the band and the band guiding device, the band guiding device should also move in the conveying direction. In addition, through such a movement, one also achieves a free space in which the boundaries "underside of the object" and "band" are essentially parallel to one another over a longer distance.

In a loop method (for banding or strapping), a possible starting point is located on the inside of the loop, thus the band loop, in which an object is then placed. The movement of the band guiding device could then, for example, take place in a downward direction or diagonally from top to bottom and from the fixing point of the loop to the edge of the counter-pressure plate which is in the horizontal direction at a greater distance from this point.

In other banding and strapping processes as well, suitable starting points and movement directions can be found.

In any case it is advantageous if the band guiding device can move further even in the case of contact with the band. In this way the band can be brought into a new position. For example, the band guiding device can move to a point that is on the same level as the lower fixing point. In the horizontal direction, this point is on the other side of the counter-pressure plate and/or the position of the counter-pressure plate when it is located between the band and the object. In this way, problem-free introduction of the counter-pressure plate is possible.

Another possibility for bringing the band and band guiding device into contact, for example, consists of the fact that the band is systematically brought into contact with the band guiding device, while the band guiding device is not moving or is standing still. This can take place, for example, by means of a hook, by means of an air pressure pulse, in that the band tension is altered, due to a change in the position of the point at which part of the band is held, etc. It is also possible for both the band and the band guiding device to be moved to create the contact.

In a preferred variant, the band guiding device is a band guiding hook.

A hook of this type preferably has a shape resembling an L. In other words, the band guiding device is advantageously an L-shaped band guiding hook. In this case the short arm is preferably at least as long as the band is wide. The hook is guided over the long arm, typically at the end thereof. This guidance takes place by way of a suitable mechanism, thus for example with the aid of suitable curve disks, guiding elements and a motor, or for example via a hydraulic or pneumatic controller, with the aid of electromagnets or cable pulls or other methods for executing a controlled movement.

It is also possible that the lengths of the arms are switched or the arms are of equal length. The selection of the length depends on the width of the band, the drive and the structure of the machine.

In addition, the arms need not be at right angles to one another. This can also result in making the design of the machine more flexible, and in addition, sideways sliding off of the band can be made more difficult.

Instead of a straight arm that makes contact with the band, the arm may also be curved or bent at the end. Such measures can also prevent slippage.

The end of the arm that makes contact with the band can be rounded off or specially smoothed. The latter can take place either directly by material processing or by a coating. A coating of this type can be relatively thick or very thin. A treatment of this type can reduce the risk of the band being damaged by contact with the hook.

The hook may be completely or partially coated to allow the band to slide better and/or to prevent slipping off to the side.

The hook may be grounded to prevent electrostatic charging of the band and hook.

Naturally, movement of the hook may also be dispensed. In this case the one arm is used for fastening the hook at the desired location.

The hook may be used as a band guiding device in the longitudinal banding method or the longitudinal strapping method as well as in another banding and/or strapping method, for example in a loop method.

Instead of a hook, in principle, simply a straight or curved pin may also be used. The band guiding device can also be another component of the machine, which is located at the desired position and around which the band can be laid.

In a preferred variant, when the overlapping band sections are being joined, substance-to-substance bonding and/or form locking connections establish the joint, especially with the aid of a joining device.

Typical substance-to-substance bonding methods are, for example, welding, adhesive bonding and/or melt-fusion. Form-locking connection of two bands may be achieved, among other things, but suitable embossing, stamping and/or folding, or for example, knotting. In the welding methods, in particular, ultrasonic welding is preferred.

The joining device performs the desired connection process, wherein the counter-pressure plate can maintain the needed counter-pressure. A joining device can, for example, be a welding head, especially an ultrasonic welding head. However, heating fins may also be used, which are inserted between the bands, with a ram that presses the heated bands against the counter-pressure plate. For example, the joining device can apply adhesive. For joining, the bands can then for example be pressed against the counter-pressure plate with a ram.

The joining device can also contain an embossing tool, for example a stamping tool. In this case the joining device can, for example, carry out folding or knotting.

The joining device is selected such that it can carry out the desired process, especially using the counter-pressure plate. In an advantageous embodiment, the counter-pressure plate is flat in shape. However, this is not necessarily the case. In particular, the design of the counter-pressure plate is adapted to the respective connection method.

The connection method can basically be selected independently of the chosen banding or strapping method. It can likewise be selected independently of the concrete design of the band guiding device. Therefore in principle all combinations are possible.

Preferably a substance-to-substance connection is produced, especially using a welding method, preferably by an ultrasonic welding method.

The bands used in banding machines and/or strapping machines are often made of plastic or coated paper. Welding methods yield stable bonds and do not require movement of the bands. Therefore they can be integrated well into the machine, for example a banding and/or strapping machine. Welding methods based on the effects of heat often require special bands or coatings. Ultrasonic welding permits a larger selection of materials. It also has the advantage that heat, gas emissions or dust hardly occur.

Adhesive bonds often require longer times before they are fully capable of load-bearing. On the other hand, however, the appearance of the bands is hardly affected.

In the case of melt-fusion, the heat applied to the bands must be accurately controlled in order not to destroy them.

In the case of adhesive bonding and melt-fusion, the joining device needs access to the space between the bands. This can make the mechanical aspects more complex.

Form-locking connections have the advantage that they can be produced often purely mechanically and quickly (e.g., embossing and stamping).

Form-locking and substance-to-substance bonding methods can often be combined.

The connection method is advantageously coordinated with the band material.

In a preferred variant, band tension is controlled with a band tensioner during the entire process.

The band tensioner is in particular a device through which the band passes. It is advantageously located between a band source, e.g., a supply roll, and the conveyor level. In particular, the band tensioner is disposed between the band source and a region at which the band, coming from the band source, has for the first time the opportunity to come into contact with the object.

The band tensioner can perform the task of controlling the band tension in various ways: According to a first embodiment, the band tensioner comprises at least two elements between which the band moves, and wherein at least one of the elements is moveable relative to the other element. A first element may comprise, for example, a jaw, a roller or a pin. The first element is particularly characterized by the fact that the band can be pressed without damage and that it can be moved relative to the second element, which may have a completely different shape from the first element, in such a manner that a band moving between the two elements will have its movement braked. In a preferred embodiment, at least one of the elements is a roller that rotates at a certain speed or in which the rotation speed cannot rise above or fall below certain minimum or maximum speeds respectively. To produce and/or control the desired speed, in particular a special motor may be used. An additional possibility is that the movement of another motor of the machine is used jointly and is suitably diverted and translated for this purpose. Instead of a rotating roller, a jaw or a pin of another element that can move in the band elongation direction may be involved. The pressure between the two elements in this embodiment can be so high that the static friction of the band on the at least one roller is larger than the dynamic friction. Therefore the band is transported in a manner controlled by the rotation of the roller, or a movement of the band is controlled by the roller.

The pressure between the elements can, for example, be produced by a spring, by magnetic forces, by a pneumatic or hydraulic device, by the weight of one of the elements or by other types of force transfer. Theoretically it is also possible for a distance between the two elements to be fixed.

The static or dynamic friction properties between the elements or the contact surfaces and the band can be influenced suitably with coatings or surface textures.

In a preferred embodiment, the band tension is modified during the process. Preferably the band tension is set lower during an initial contact of the band with the object than during the time period in which the at least two band sections are made to overlap.

In a method for wrapping a band around one or more objects (preferably a banding method and/or a strapping method), especially if the object is delicate, it may be advantageous for the band to be only slightly tensioned at the time of initial contact with the object. In this way only small forces will be produced at the contact points of the object.

In many instances, however, higher band tensioning is desired for the actual wrapping process (preferably banding or strapping), e.g., to enclose the object securely and firmly. The use of a band tension that can be varied during the process makes it possible to fulfill both requirements: the band tension can be low at the time of initial contact and be increased before the band is connected. At the time of the increased band tension, the contact area between object and band may, under some circumstances, already be distinctly higher than at the time of initial contact, so that the object is not damaged by the higher band tension at the later time. A similar change in the band tension can also, in the case of an object consisting of a stack of items that project to different distances in the conveying direction, prevent these items from shifting relative to one another or can keep the shifting smaller than would be the case without a change in the band tension. However, it is also possible for the band tension to be large at first and then become smaller. For example, one edge or side of the object may be deliberately breached in order, for example, to keep a relatively loose band from slipping off of the object.

Depending on the design of the band tensioner, the band tension can be modified by various mechanisms: In the case of a band tensioner that uses dynamic friction, thus in which the band passes between two elements essentially standing still relative to the band, the band tension is regulated by changing the pressure between the two elements. However, the surface characteristics of the band and/or one and/or both elements may also be modified. This may be done, for example, by applying a lubricant or inserting intermediate layers.

In the case of a band tensioner that uses static friction and therefore has movable parts such as a rotating roller, the band tension can preferably be performed through a change in the travel speed of the movable parts. If a motor is used for driving and/or controlling, for example, its rotation speed may be adjusted.

However, it is also possible for a band tensioner that uses static friction to change the pressure between the elements and/or their surface texture and/or the surface of the band to undergo changes such that there also, sliding of the band between the elements will occur.

In a preferred variant, the band tension is regulated by a control unit, specifically by electrical signals.

The regulation of the band tension via a control unit has the advantage of user-friendliness and safety. Especially during running operation, which is especially desirable for changing the band tension during the procedure, for safety reasons the user should not have to directly manipulate a component of the machine that is not explicitly intended for this purpose.

However, it is entirely conceivable for the band tensioner to be mounted and/or designed such that it is also adjustable directly and without control device at any time in such a way that it causes the band tension to change.

Electrical signals have the advantage that they can be easily generated and transmitted, and a relatively large freedom in selecting the transmission means is available. This is not so easy, for example, in the case of cable pulls, which could also enable signal transmission. Wireless signal transmission using electromagnetic waves requires special receivers on the band tensioner. On the other hand, with the aid of a suitable electrical signal, a motor or brake for influencing or controlling the movement of an element or the pressure between the elements, can be controlled directly. A pump, valve and other controls of a pneumatic or hydraulic mechanism can also be influenced electrically. With a very large number of pressure production methods, the change in pressure between the elements can also be adjusted directly by cable pulls. However, one advantage of electrical signals is that they can be generated or modified relatively easily and in the currently usual form by programmable control units.

For regulation of the band tension it is of interest not only to regulate the band tension but also to measure it in a preferred variant. Suitable sensors can be directly incorporated in the band tensioner and measure, for example, the extent to which at least one or more elements are pulled in the band direction by the band, or the torque of the band on, for example, a roller. Together with the known dynamic and/or static friction properties between the measured element and the band, a force and thus the band tension can be determined from this. One or more comparable sensors could also be attached (additionally or alternatively) to the lower fixing point. The band can also be systematically deflected at one point through a test rod, movable but spring-loaded, coupled to a sensor (e.g., along the band guide to be described below and behind the band tensioner) and the movement or deflection of this test rod determined by this sensor. The measurement systems suggested here are only examples and not a complete list. Theoretically all band tensioning methods are possible.

If the band tension is controlled by at least one electrically operated roller, the torque produced by the band tension can be indicated in current and/or voltage signals.

By comparing the planned capacity of the brake or motor used to the capacity utilized, the band tension can be measured in this way. A measurement of this type has the advantage that the actual sensors (e.g., a voltmeter and/or ammeter) can be integrated in the control unit and a separate data line is not required.

A preferred embodiment for wrapping a band around at least one objects comprises a method in which the object band loop is placed around the object and which comprises at least one of the following steps (in the following the complete process steps will also be denoted as "Method for placing an object band loop"):

- Holding the beginning of a band in the rear holding device below the conveyor level;
- Tighten a band between the rear holding device holding the beginning of the band and the lowerable band guide located in a level above the objects;
- Moving a part of the band in the conveying direction with an object which is moving on the conveyor level in the conveying direction and thus makes the band protrude;
- Placing an additional section of the band below the conveyor level through the band guide;
- Forming the band into a loop which is located below the conveyor level, is closed in the conveying direction and comes out from the band guide, especially with the aid of a loop puller.

The rear holding device here represents the lower fixing point. The rear holding device among other things defines the position of the lower end of the freely tightened band before it comes into contact with the object to be wrapped by the band, preferably the object to be banded and/or to be strapped.

On the band guide, at the position in a level above the object, is the position of the upper end of the freely tightened band. The rear holding device holds the band tight locally, so that the clamped portion cannot slip through or over the holding device. In contrast to this, the band guide is preferably designed such that, to be sure, it controls the path of the band, but does not locally fix the band. Therefore in this embodiment the band can and should move in or around the band guide, when for example the movement of the object or the movement of the band guide or a movement of the machine tightens the band with a certain force. The band guide and band tensioner can be a unit with which the path of the band and the band tension can be controlled at the same location. The band guide can simply be, for example, a pin, a roller, or a surface which may be curved. The band is placed over a band guide of this type, and it can either slide on it, or it is movably supported through the rotation of the roller or the movement of the pin or surface. A pin, surface or roller of this type may be surrounded by devices for preventing slippage of the band, for example side closures in the form of short rods or surfaces. It is advantageous for the friction between band and band guide to be kept low if the band tensioner is not part of the band guide. Otherwise in this case the band tension generated by the band guide would have to be taken into consideration in the tension regulation of the band, which would make the adjustment of the band tension somewhat more difficult. In addition, the smallest possible band tension would be increased by the friction between the band and the band guide.

The rear holding device is typically a clamp. Thus it consists of two jaws that can be pressed together. The band to be held can be clamped between them. The jaws are selected and the pressure determined such that the even at the highest band tension occurring in the method, the band cannot be pulled out from between the jaws. In a preferred variant, the band is not damaged by the clamping. Since this relates to the beginning of the band and as the beginning of the band is located close to the joint region in the finished product, damage to the band at this point would be less noticeable than at other points. It is therefore conceivable that the band will also be held by the rear holding device using a method that damages the band. For example, this might be one or more needles pushed through the band.

If an object moves in the conveyor level towards the band tightened between the rear holding device and the band guide in its upper position, it will contact the band at a certain time. Because of the continuation of the movement and the possibility of the band to move through the band guide that the band will increasingly protrude out. The term "moving through the band guide" is also intended to include the sliding of a band over the surface of a band guide provided for this purpose.

However, in this process the object cannot be completely surrounded by the band, since in the case of physical objects there are always points at which their local normal vectors point at least partially away from the direction of movement of the object, and these points also occur in each wrapping region. Simply due to the movement of the object and the protrusion of the band, no band can be brought to these points. This is therefore accomplished with the assistance of the band guide, which presses the band behind the object below the conveyor level. It preferably attains the necessary mobility through a movable arm on which it is supported.

In another embodiment, the band guide can for example also contain suitable rails and a suitable sled on the band guide or the band guide could be placed on a type of rod which can be raised or lowered.

To close the last piece of the object band loop, the band must be brought from the lowered band guide to a place beneath the object, where the rear holding device with the beginning of the band is located. This is done using the loop puller. In a simple case the loop puller is a L-shaped hook or a pin. For both variants, there should be a servicing point in the band guide. The pin or the hook is placed at this servicing point between the band guide and the band. In a preferred variant, the band guide is designed such that the band is held in the vicinity of the band guide above and below the servicing point. This can, for example, take place over two suitable pins or a housing in which there is only around the servicing point an opening. However, the band may also be held in or on the band guide, for example, with the aid of a partial vacuum. The loop puller is now placed at least partially in the servicing point and thereby between the band and the band guide.

According to an additional possible embodiment, the loop puller comprises a device that pulls the band by vacuum.

If the loop puller is now moved in the conveying direction, it will move the band along and thus create a loop that starts and ends at the band guide.

In a preferred method, the band tension is regulated such that it takes a first value while no object is touching the band, a second value while the band is being moved by the object and a third value while the band guide is pressing the band down or moving it.

In an additional preferred method, the second value for the band tension is not larger than the third.

It is also possible for the first, second and third values not to be constant over time, but to continuously pass over into one another.

This allows the above-described choice of a final band tensioning with simultaneous edge protection of the object as well as the deliberate and intentional shaping of the edge of the object by the band. The first value is the tension that the front edge of the object can endure or with which the front edge is to be processed. The second value should be selected, among other things, with regard to the transport mechanism of the objects. Excessive band tension would make the object slow down, stop, or even press back against the transport direction. Upon lowering the band guide, the object is already mostly surrounded band. The forces are distributed more uniformly over the surfaces touched by the band and since a certain length of the band is still in use, a band tension can be built up without requiring a mechanism that pulls the band back. Since the band already surrounds most of the object, the risk that the object or parts thereof will be unintentionally moved at this time is lower.

A sudden or abrupt change in the band tension can, under certain circumstances, mean that despite actually suitable band tension values, unintended damage occurs or the band sticks or hangs up locally. At a lower band tension the band may stick to the object or hang up on it, but this can change in case of a sudden change to a higher band tension.

As a result, too much of the band can be present in the object band loop all at once. In addition, in the case of sudden transitions, chronological coordination with the movement of the object may be difficult. Slow and steady transitions between the different band tensions may help to avoid such problems.

In a preferred variant the objects are detected by a sensor, especially a light barrier, before they touch the band.

Especially in this case, using a signal from the light barrier and a known speed of the object in the conveying direction, the size of the object in the conveying direction and its arrival time on the band are determined.

As was mentioned in the preceding, the band guide lowers behind the object. In addition, for example when the band tension is changed, it may be useful to know the time point at which an object makes contact with the band. This time can be determined in various ways, e.g., by observing how much band is used up at a given band tension. An additional variant consists in measuring the object and its position at an earlier time point, and moving the object after this measurement only in the known manner.

The size of the object, which is of principal interest here, is its extent in the conveying direction. This can be determined relatively simply, for example, with a light barrier through which the object moves at a known velocity. In a preferred embodiment the velocity is constant, since this makes the evaluation easier and more robust. However, the velocity may also change. Nevertheless the velocity should essentially be known at essentially every measurement time point for meaningful evaluation. If the object moves with a known velocity even after leaving the light barrier, if the distance between the light barrier and tensioned band is known, and if the time at which the object begins to block the light barrier is detected, the arrival time at the band can also be determined.

Similar evaluation methods can also be applied to other sensors that can determine the presence of an object: for example, a sensor that determines weight or electrical properties such as conductivity or permittivity may be used.

Other evaluation methods and measurements encompass the object as a whole. In this case, time recording or time interval recording is not needed to determine a length. To predict the time of band contact, on the other hand, time recording and a known velocity development are needed here as well. Possible measurements in this category are, for example, imaging methods such as the use and evaluation of a camera that is sensitive in a suitable wavelength range.

In a preferred embodiment, a controller regulates the execution speed of the process steps and optionally the control unit for the band tension. The regulation takes place especially as a function of the measurements of the extent in the conveying direction and/or the determination of the arrival time on the band. It is also possible that the regulation of the execution speed takes place based on information from a memory in the controller or from external data storage units and/or additional measurements.

Here a distinction is made between the controller that regulates the execution speed of the process steps and the control unit that regulates the band tension. In a preferred variant, however, both regulation tasks are performed in a component, a general controller. This facilitates the synchronization of possible band tension changes and process steps.

In a possible process step, for example, the band guide lowers itself after passage of the object. For this purpose, in particular, information is needed on when the object has passed the point at which the band guide pushes through the conveyor level. This information can be calculated, for example, form the arrival time on the band and the size of the object in the conveying direction. The information can be measured or stored in an internal memory or in an external data storage unit. An additional possibility is to supply a sensor that can detect the end of the object close to the location at which the band guide passes through the conveyor level.

Measurement data and/or stored data are also preferably used for the controlled change of the band tension. In addition to measuring the extent of the object in the conveying direction, the control, the general control or the control unit can be designed such that, for example, it can use information about the exact shape of the object and limit values for the strength at certain points to appropriately regulate the process velocity and/or band tension.

In a preferred embodiment, the method for wrapping a band around one or more objects comprises at least one of the following process steps (the complete set of process steps will also be denoted as "Method for introducing the counter-pressure plate"):

- Holding the beginning of a band in the rear holding device below the conveyor level;
- Moving part of the band in the conveying direction with an object which is moving in to the conveying direction on the conveyor level;
- Guiding and/or positioning the band through the band guiding device such that a defined free space for introducing the counter-pressure plate is created and
- inserting the counter-pressure plate below the conveyor level into the free space between the band and the object, created by the band guiding device.

In a preferred embodiment the counter-pressure plate is slid in from the side or essentially perpendicular to the conveying direction. The free space for this is created by the band guiding device. The counter-pressure plate is preferably one piece. However, it is also possible to use a counter-pressure plate comprising two or more parts. These can then be suitably pushed together from the same side or from different sides.

In a preferred embodiment, the method for wrapping a band around one or more objects comprises one or more of the following steps (the complete set of process steps will also be denoted as "Method for overlapping band sections"):

- Holding the beginning of a band in the rear holding device below the conveyor level;
- Moving part of the band in the conveying direction with an object which is moving in the conveying direction on the conveyor level;
- Placing an additional section of the band below the conveyor level using the band guide;
- Holding the band at a front point with a front holding device;
- Releasing the beginning of the band with the rear holding device, especially chronologically following the above-named process steps.

A method for overlapping band sections also comprises the step of forming a loop in the conveying direction, starting from the band guide, especially with the aid of a loop puller (100), wherein the loop expands to such an extent that it overlaps with the beginning of the band.

A second method for overlapping band sections also comprises the step of bringing the band into a loop which is located below the conveyor level, is closed in the conveying direction and starts from the band guide, especially with the aid of a loop puller, and also holding the band in the area of an upper part of the loop with an additional holding device. Then severing the band in the area of the loop, and spreading the now open loop, especially with the loop puller, wherein before severing the loop is of a size and a severing point is selected such that the band overlaps with the beginning of the band.

The first part of these two methods was already discussed in the preceding. Novel among other things is the step of holding the band at a front point with a front holding device. The band is brought to the front point by the movement of the object and/or the band guiding device. The front holding device is intended to hold the band in such a way that it cannot slip through this device, specifically under tensions up to the maximum occurring band tension, in the band wrapping method to be conducted, which is preferably a banding and/or strapping method. In a preferred embodiment, the band is not damaged by the clamping. Therefore in one embodiment the front holding device is a clamp. This clamp comprises two jaws that are of suitable shape and can be pressed together with sufficient force to hold the band up to the maximum band tension. One of the two jaws in this case may also be part of the counter-pressure plate. The second jaw can also be part of the surface of another component of the machine.

At a certain time in particular the band is held at two points simultaneously: for example, the beginning of the band is held by the rear holding device and a piece of the band is held at a front point with a front holding device. The front and back holding devices need not be at the same level. However, the front holding device is located horizontally in front of the back holding device ("front" and "back" are defined relative to the conveying direction). As soon as the front holding device is holding the band securely, the beginning of the band can be released from the rear holding device. The time span between the two events is variable, but not the sequence.

In the first of the two possible methods for overlapping band sections, a loop is pulled by the loop puller (e.g., in the manner discussed in the preceding), with a length (measured in the conveying direction) such that the end of the loop comes to lie in front of the rear holding device and below the counter-pressure plate. At this point the beginning of the device can either still be held in the rear holding device or may have already been released by this. If the latter is the case, the beginning of the band hangs down, but the loop can be large enough that it also overlaps with this downward hanging beginning of the band.

Here, "overlapping of the bands" means that when looking directly at a band surface of one of the bands, this band covers the other band at least partially. Thus in the case of overlapping with a loop, a lower section of the loop overlaps the upper section of the loop and both loop sections overlap with the band, especially the beginning of the band, which lies above the loop.

In the first of the two possible methods, the two overlapping band sections are the beginning of the band and the band loop.

In the second of the two possible methods for overlapping band sections, a loop is also produced by the loop puller (e.g., in the manner mentioned in the preceding). An additional holding device is used to hold the upper part of the loop. The additional holding device, for example, is essentially the same as the front holding device in terms of its requirements and possibilities. However, it holds the upper part of the loop at a point located behind the front holding device in the conveying direction. In a preferred embodiment, the beginning of the band is released by the back holding device at the latest after the additional holding device retains the upper part of the loop. The back holding device does no longer holds anything at this stage and in a preferred embodiment can hold the lower part of the loop. As soon as this has happened, the loop is severed, preferably immediately in front of the rear holding device or at another location of the lower part of the loop. If the rear holding device does not hold part of the lower loop, the loop can be severed at any desired, allowed location. In a later part of this text we describe how the length of the loop and the severing point should be selected for a reliable solution.

The rear holding device and the additional holding device can also have a component or a structural element in common, which for example has clamp jaws on two sides. The additional holding device may use part of the counter-pressure plate as the second jaw. In this manner it is found that in a possible embodiment the additional clamp consists of part of the counter-pressure plate and a first clamping piece and the rear clamp consists of the first clamping piece and a second clamping piece. The first clamping piece has two jaws located on opposite sides. The first and the second clamping pieces can be moved together or separately. In this way it is possible to release the additional clamp without loosening the rear clamp and vice-versa, or to keep both clamps closed or open at the same time.

The severing of the band can be done with one or more suitable knives or scissors. However, the severing can also be done with a hot wire. In principle, two very strong clamps may also be used and tension applied to the band until it tears. It is also possible to perforate the band with needles until it is severed or tears with the smallest strain. Other severing methods also are not ruled out.

At this time or during the severing of the band, the loop puller is typically still at the apex of the loop. After the band was held at at least one point (for example, upper part of the loop) (e.g., by the additional clamp) and severed, in a preferred embodiment the loop puller moves further so that the now newly severed band end moves in the conveying direction. Alternatively or additionally, an additional component can spread the now open loop. Depending on the band material, it is also possible to dispense with active spreading altogether, e.g., if the band assumes a suitable position on its own.

The spreading of the open loop by the further movement of the loop puller is preferably understood to mean that the band is smoothed out or pressed against the counter-pressure plate. Thus this involves smoothing along the counter-pressure plate. Then in this preferred embodiment the open loop lies directly on the band. When the two are joined, therefore, no uncontrolled free space can continue to exist, and the size of the banderole is therefore accurately known or defined.

The loop that the loop puller has produced before cutting is, in particular, so large and specifically the severing point is selected such that the band length extends from the additional holding device at least to before the beginning of the band. At least part of the overlap region is located beneath the counter-pressure plate. Preferably the band end extends in the conveying direction over the counter-pressure plate.

In the second of the two possible methods, the band sections that are overlapped are the beginning of the band and the band end.

In a preferred variant of the method for overlapping band sections, the method also comprises a step of placing and retaining the beginning of the band by a band start holding device at a site located above a loop created by the loop puller.

In an additional preferred embodiment, the site above the loop is the underside of the counter-pressure plate.

In an additional preferred embodiment the band start holding device is a band start clamp.

If the beginning of the band is released from the rear holding device without additional measures, the band hangs down in an arc shape from the front holding device. The stiffness of the band determines how narrow the arc in which the band curves will be and thus also the position of the beginning of the band, which is now the lowest point. This situation is not optimal, in particular, if it is necessary to work with different bands. Specifically, as described in the preceding, the positioning and the size of the loop pulled by the loop puller depend on the position of the beginning of the band. However, in the case of varying bands, exactly this position is initially unknown and it is also difficult to determine automatically without additional sensors being used. Therefore in a preferred embodiment a band start holding device grasps it shortly after it has been released by the rear holding device and holds it until after the bands are joined in a known position or in a target position. Since the beginning of the band is preferably to be located above the upper part of the loop, but especially still beneath the counter-pressure plate, the band start holding device advantageously positions the beginning of the band at such a location. Whereas the position of the loop is variable within a certain scope, the level of the underside of the counter-pressure plate is usually clearly defined. It is therefore advantageous to place the beginning of the band directly in a region on the underside of the counter-pressure plate.

The band start holding device is preferably a band start clamp that can clamp the band. Advantageously one of the jaws of this clamp is designed as part of the counter-pressure plate. However, it is also possible for both clamps to be independent components that only perform the clamping function. It is also possible for at least one of the clamps to be components which, in addition to the clamping function, also perform at least one additional function. Since there is scarcely any band tension on the band at this clamp, the requirements for holding strength are distinctly lower than in the case of the front, rear or additional holding device.

Instead of or in addition to a clamp, it is therefore also possible to operate, for example, with a vacuum as the sole or as further holding means at this point. It may also be sufficient to use a supporting surface, for example a pin or a table, on which the beginning of the band may partially lie. To prevent the beginning of the band from slipping off, the supporting surface may be coated and/or textured.

In a preferred embodiment, the method for wrapping a band around at least one objects comprises the following process steps [in the following, steps a)-c) will be designated as "Method for joining the band"]:

a) the process steps designated in the preceding as a method for introducing the counter-pressure plate
b) the process steps designated in the preceding as a method for overlapping band sections.
c) the joining of the band sections with the joining device in the area of the overlap.

All three process steps a), b) and c) and methods were already explained earlier.

Preferably the method for wrapping a band around at least one object is a banding and/or strapping method, especially a banding method.

If the counter-pressure plate is introduced before process step b), the counter-pressure plate can be used for process step b). This can simplify the structure of the front, the additional and the band start holding device, as was explained in the preceding.

The joining assumes overlapping band sections. This prerequisite can be fulfilled advantageously by process step b).

In a preferred embodiment, the method for wrapping a band around at least one objects comprises the following process steps [in the following, steps a)-c) will be designated as "Method for joining the band" ]:

a) the process steps designated in the preceding as a method for placing an object band loop
b) the process steps designated in the preceding as a method for introducing the counter-pressure plate
c) the process steps designated in the preceding as a method for joining the band, wherein preferably the process steps of the method for overlapping band sections in which the loop is severed are also used and
d) the holding of the band in the region of a lower part of the loop by the rear holding device after the loop puller has formed a loop and before the band is severed in the area of the loop, preferably shortly in front of the rear holding device, and
e) the removal of the counter-pressure plate from the area between band and object after the band has been joined with itself.

Preferably the method for wrapping a band around at least one object is a banding and/or strapping method, especially a banding method.

The goal of wrapping a band around at least one object, preferably banding or strapping, is to place an object band loop around an object. A counter-pressure plate facilitates procedure c) as explained in the preceding. The variant of c) with severed loop has the advantage that only two and not three band layers need to be joint. In addition, loops are positioned on the outside of stacked goods, which are many banded or strapped objects, present a risk of getting caught. This can be prevented by severing the loop. In addition, the band consumption can be reduced if the severing takes place at a suitable point. The holding of the band in the area of the lower part of the loop by the rear holding device before severing the band means that after the end of the procedure, the machine is again in the starting position and the next object can be wrapped, preferably banded and/or strapped, by a band. Without holding, the new beginning of the band will be lose and would first have to be returned manually or by other means to the starting position in the rear holding device. If the band were to be held behind the severing point by another holding device, the position of the new beginning of the band would be known, but to repeat the same process a second time, it would be necessary to change the holding device. Therefore the use of the rear holding device is advantageous for this purpose.

The removal of the counter-pressure plate from the area between band and object after the band has been joined to itself releases the object wrapped with a band, thus the banded or strapped object. The counter-pressure plate is preferably simply pulled out to the side, wherein "to the side" means that the main component of the movement is perpendicular to the vertical and perpendicular to the conveying direction. Twisting out around a vertical axis outside of the region covered by the band is also possible. The movement of the counter-pressure plate is preferably performed such that the counter-pressure plate ends up at the place where it was at the beginning of the wrapping process, preferably the banding and/or strapping process. This is especially outside of the wrapping region. It may be necessary first to release the front and/or the additional and/or the band start holding device. If the counter-pressure plate is not a component of one or more holding devices, it can also be released before the holding devices and the three holding devices mentioned only afterwards. The rear holding device should remain closed, since it holds the new beginning of the band.

After all these steps the object is now surrounded by a band, preferably banded and/or strapped, free to be transported away, and if the band guide has also be moved back into the level above the objects, all components should be at the positions where they should be for wrapping a band around the next object using the same method. The process can be repeated.

It is entirely possible to perform banding and strapping in succession using the same machine. The method described here is the same in this instance. In this process, under certain circumstances a controller or a user can change the band and/or change the band tension controller to the desired value before repeating the process. Additional adjustments may likewise be made.

It should be noted that the chronological sequence of the different process steps can be varied within certain ranges. In this way, for example, the procedures "placing an object band loop" and "inserting the counter-pressure plate" may overlap in time.

To illustrate possible combinations, the different steps will again be summarized here and labeled with a key (A to Q):

A: Holding the beginning of a band in the rear holding device below the conveyor level.
B: Tightening a band between the rear holding device holding the beginning of the band and the lowerable band guide located in a level above the objects.
C: Moving part of the band in the conveying direction with an object which is moving on the conveyor level in the conveying direction and thus makes the band protrude.
D: Placing an additional section of the band below the conveyor level by using the band guide.
E: Guiding and/or positioning the band through the band guiding device such that a defined free space for introducing the counter-pressure plate is created.
F: Inserting the counter-pressure plate below the conveyor level into the free space between the band and the object which was created by the band guiding device.
G: Holding the band at a front point with a front holding device.
H: Release of the beginning of the band by the rear holding device.
I: Placing and retaining the beginning of the band by a band start holding device at a site located above a loop created by the loop puller.
J: Forming the band into a loop which is located below the conveyor level, which is closed in the conveying direction and starts out from the band guide, especially with the aid of a loop puller.
K: Formation of a loop starting from the band guide and proceeding in the conveying direction with the aid of a loop puller (100), wherein the loop expands to such an extent that it overlaps with the beginning of the band.
L: Holding the band in the area of an upper part of the loop with an additional holding device.
M: Holding the band in the area of a lower part of the loop by the rear holding device after the loop puller has formed a loop and before the band is severed in the area of the loop, preferably shortly in front of the rear holding device.
N: Severing the band in the area of the loop.
O: Spreading the now open loop with the loop puller, wherein before severing the loop was of a size and the position of the severing was chosen such that the band overlaps with the beginning of the band.

P: Joining the band sections with the joining device in the area of the overlap.

Q: Removing the counter-pressure plate from the area between band and object after the band has been joined to itself.

Particularly advantageously here, some or all of the following conditions are met:

Step B is performed after step M and before steps C and E.

Step C is performed after step B and before step D.

Step D is performed after step C and before either step J or step K.

Step E is performed after step B and before step F.

Step F is performed after step E and after step C and before step B, preferably before at least one of steps G and L.

Step G is performed after step C; however, if G is performed before F, the front holding device must be designed such that the counter-pressure plate is not part of it. Step G is performed after step H.

Step H is performed after step G and before step I; if I is not performed, step H is performed before step M.

Step I is optional and if it is performed, it can be performed after step H and before one of steps J or K.

Either step J or step K may be performed, both after step D and before step L, if it is performed, and before step M.

Step L can be performed after step J or K. If step F has not yet been performed, the additional holding device must function without a counter-pressure plate. If step K was performed, step L may also be dispensed with. Step L is performed before step N, if it is performed.

Step M is performed after steps J or K and after step H and before step N.

Step N is performed after step M and before step C.

Step O is optional and, if performed, it is performed after step N and before step P.

Step P is performed after steps J or K and after step F and before step Q.

Step Q is performed after step P and before step C.

Steps E and F may only be performed in succession, but simultaneously with steps C and/or D.

Steps H and I can only be performed in succession, but simultaneously with step J or K.

Depending on the band path and construction of the band guide, either step L or step M may be performed together with step J or K.

With this an efficient and continuous wrapping of bands around objects, for example banding and/or strapping, may be achieved.

In a discontinuous method or in a machine that accomplishes certain individual tasks, such as that of taking up the beginning of the band, in a different way, some of these conditions may be managed differently under some circumstances. These possibilities were already discussed earlier.

The method for introducing a counter-pressure plate is advantageously executed by a special device for introducing a counter-pressure plate between a band and a conveyor level in a machine, preferably a banding and/or strapping machine.

An additional aspect of the present invention therefore relates to a device for introducing a counter-pressure plate between a band and a conveyor level in a machine, especially a machine for wrapping a band around an object. This is especially part of a device for banding objects, a banding machine, a device for strapping objects or a strapping machine. The device for introducing a counter-pressure plate comprises:

a) A rear holding device which can hold a beginning of the band and b) a conveyor level with an opening which is located above the rear holding device and on which an object can be moved in a conveying direction, wherein in this movement of the object a band is drawn in the conveying direction through the opening in the conveyor level, the beginning of the band is held by the rear holding device and which projects through the opening in the conveyor level, wherein c) a band guiding device is present, which positions and/or guides the band beneath the conveyor level, creating a free space for inserting the counter-pressure plate between the band and conveyor level.

The word "realized" here is used with the following meaning in connection with levels: A realized level is a part of a level in which a physical surface is located. Thus for example a smooth, non-curved table surface realizes the level that can be defined by the table surface, which means the level that is spanned by linearly independent vectors lying on the surface of the table.

Most of the components of the device have already been described in connection with the method. An opening in the conveyor level is mentioned. The conveyor level is the level in which the undersides of the objects move, as previously mentioned. Typically, it is realized by a table or a conveyor belt or a combination of the two. However, it is also possible for the objects to be held and conveyed on the sides. In such a case there is no component that realizes a continuous conveyor level. Thus even if there is a table, a conveyor belt, a guide rail or the like, the conveyor level can project out beyond the edges of this realization of the level. Therefore the conveyor level is to be understood in the sense of a mathematical construct in some areas if necessary.

The opening in the conveyor level, on the other hand, is always physical in nature: An opening is present at the points at which the conveyor level is not realized. In the example in which the objects are only held and conveyed on the sides, an opening in the conveyor level is present between the sides. Thus a space between tables or conveyor belts that realize the conveyor level is an opening in the conveyor level. An individual table edge can also be an edge of an opening, as can a hole in a table or conveyor belt.

In particular, the opening is perpendicular to the conveying direction at least as wide as the band. Preferably the opening in the area of the band guide is at least as wide as the band guide perpendicular to the conveying direction. This allows the band guide to guides the band through the opening below the conveyor level.

A length of the opening in the conveying direction in particular is at least as large as the to total of the thickness of the band, the width of the counter-pressure plate in the conveying direction and the thickness of the band guide perpendicular to the conveying direction.

Here, width and thickness of the band guide refer only to the part of the band guide that extends below the conveyor level at some time. Depending on how the band guide is brought below the conveyor level, this is not a matter of the thickness and width of the band guide itself, but of the thickness and width of the volume which the band guide ever occupies in the conveyor level during the entire process. If the conveyor level is realized by an object, it is necessary to keep in mind that this has a certain thickness and parts of the band guide must also pass through this area.

In addition, the invention relates to a device or machine for wrapping bands around an object, preferably a banding machine and/or a strapping machine, comprising the following parts:

a) A device for introducing a counter-pressure plate as described in the preceding;
b) a lowerable band guide which can be located in a level above the objects and which may be located below the conveyor level and in both positions can guide the band and in a starting position in the level above the objects tightens the band between itself and the rear holding device;
c) a counter-pressure plate that can be brought below the conveyor level between the band and the underside of the object and removed again;
d) a front holding device that can fix the band at a point in front of the rear holding device;
e) a loop puller (100) that can pull the band starting from the band guide in the position beneath the conveyor level, in the conveying direction, into a loop;
f) a severing device that can sever the band, preferably directly behind the rear holding device; and
g) a joining device that can join the band to itself in an overlapping region.

The components of the device have already been described in connection with the method, as have their variations and advantages. Since these are the same components, these statements are to be understood as also applicable for the device.

The device for wrapping bands around objects, preferably for banding and/or strapping, preferably comprises preferably an additional holding device that can hold the band in the area of an upper part of the loop.

The additional holding device and the alternatives and advantages thereof were also discussed in connection with the method. These statements are analogously applicable for the device.

The device for wrapping bands around objects, preferably for banding and/or strapping, preferably comprises in additional a band start holding device that can position the beginning of the band again after it has been released by the rear holding device, especially by bringing the beginning of the band to the counter-pressure plate through the band start holding device. The band start holding device is preferably a band start clamp.

The band start holding device and the alternatives and advantages thereof were also discussed in connection with the method in the preceding. These statements are analogously applicable for the device.

The device for wrapping bands around objects, preferably for banding and/or strapping, advantageously also comprises a loop puller which, once a loop has been opened, can spread this apart so that only two band layers are present in the overlapping region, especially so that only two band layers are located between the joining device and the counter-pressure plate.

An opened or severed loop means a band arrangement that essentially has the form of a loop. In other words, the band, starting from one location, spreads in one direction. At a second location, the vertex of the loop, the direction of spread of the band changes continuously, so that the band finally leads to a third location close to the starting location. This is a loop. An opened or severed loop is now characterized by the fact that the band is interrupted at one point of the loop.

A band layer is a band located above or below something, two band layers are two overlapping bands, three band layers are three overlapping bands, and x band layers are x overlapping bands, wherein x is a positive natural number greater than 1.

The joining device of the device for wrapping bands around objects, preferably for banding and/or strapping, is advantageously a welding head, especially an ultrasonic welding head.

The benefits and drawbacks and modifications of different joining methods were discussed in the preceding in connection with the method. A welding head is the device used for a welding process. The arguments and alternatives embodiments described for the method apply analogously.

The band guiding device of the device for wrapping bands around objects, preferably for banding and/or strapping, is preferably a band guiding hook.

The band guiding hook and the alternatives and advantages thereof were discussed in the preceding in connection with the method. These statements are analogously applicable for the device.

The band guiding device of the device for wrapping bands around objects, preferably for banding and/or strapping, is can advantageously be placed between the band and the conveyor level and move in the conveying direction.

The possibilities for moving the band guiding hook, the alternatives and advantages thereof were discussed in the preceding in connection with the method. These statements are analogously applicable for the device.

The conveyor level of the device for wrapping bands around objects, preferably for banding and/or strapping, is preferably defined by a conveyor table.

How a table can define a level was explained in the preceding. If the conveyor level is defined by a conveyor table, this has the advantage that the objects can simply be slid across the table during the process. Many other transport methods require adaptation to the object, which is difficult to realize in the case of different objects in an unknown order or nonstandardized objects. In addition, a table allows the movement of objects that are stacks of loose articles. Precisely these are often banded and/or strapped. It is therefore advantageous if the device is suitable for such objects. An alternative for a table with similar characteristics is, for example, one or more conveyor belts or transport rails.

The free space for introducing the counter-pressure plate in the device for wrapping bands around objects, preferably for banding and/or strapping, is preferably partially delimited by the band. This proceeds from the rear holding device to the band guiding device and from there to the object and/or an edge of the opening in the conveyor level.

An additional aspect of the present invention relates to a band tensioner that can regulate a band tension. The band tensioner is preferably electronically controllable. In addition the band tensioner can preferably change the band tension during operation of the process.

The band tensioner in particular is a component of the device for wrapping bands around objects, preferably for banding and/or strapping.

Preferably the band tensioner also comprises a device for detecting the band tension.

The band tensioner and its control possibilities, the modifications, alternatives and advantages thereof were discussed in the preceding in connection with the method. These statements are analogously applicable for the device.

The possible modification during ongoing operation shall also allow changes to be made during wrapping of a band around a single object or a single group of objects. This modification should preferably also be enabled during the banding and/or strapping process.

The device for wrapping bands around objects, preferably for banding and/or strapping, advantageously also comprises a control unit. This control unit is preferably designed such that it also controls the band tensioner.

The control unit and the interaction between the band tensioner and the control unit, the modifications, alternatives and advantages thereof were discussed in the preceding in connection with the method. These statements are analogously applicable for the device.

The device for wrapping bands around objects, preferably for banding and/or strapping, preferably comprises also a device for detecting the band tension. In particular, the band tensioner can be designed such that in addition to adjusting the band tension it can also measure it.

Possible measurement methods and locations for detecting the band tension were described in the preceding in connection with the method. The possibilities for using the band tensioner for this purpose were also explained there.

Preferably the device for wrapping bands around objects, preferably for banding and/or strapping, comprises at least one sensor for detecting the position and/or the size of the object in conveying direction. This sensor comprises in particular a light barrier.

Possible measurement methods and locations for gaining information about the object were described in the method.

Preferably the device for wrapping bands around objects, preferably for banding and/or strapping, comprises a controller which can control and synchronize the velocity of the different process steps.

For continuous production, rapid wrapping with bands, especially rapid banding and/or strapping, may be advantageous. For test purpose on the other hand, slower operation is preferred. It may also be advantageous to synchronize the wrapping of bands around objects, especially the banding and/or strapping, with procedures taking place before or after that in a production chain. In the case of special bands or special products, some steps may be performed more slowly or more quickly than in other situations. With the aid of the controls, the devices may be adapted to the respective needs.

In an additional embodiment the device comprises several, preferably two, supply rolls for bands. The supply rolls serve to take up and provide the band before the actual banding process. Preferably the supply rolls are coordinated with one another by a supply roll controller in such a manner that one supply roll can be changed in each case while bands are being drawn off of another supply roll.

In particular the coordination by the supply roll controller enables the joining of a band end from one roll with the beginning of the band from another roll. Preferably during the welding of one band end with the beginning of another band, the band end and beginning of the band overlap by less than 1 cm. In particular the overlapping region is less than or equal to 0.7 cm long.

In a further embodiment the device comprises a connecting device with which a band end of one band on a first supply roll can be connected to the beginning of a band on a second supply roll.

Preferably the connecting device is a welding device, especially an ultrasonic welding device.

In an additional embodiment the device especially comprises a band storage unit. This makes it possible for the banding process to continue running for a certain time without braking or even slowing without the band on the other side of the band storage unit moving because of the banding process. This decoupling in particular allows the joining of a band end from one roll with the beginning of a band from another roll without the banding process being slowed by this. The band storage unit is controlled by a band storage unit controller. The band storage unit controller can be used to empty the band storage unit in a controlled manner and also to fill it again in a controlled manner at another time. One embodiment of the band storage unit is a band guidance over at least three deflecting rollers, at least one of which is movable relative to the other two. Through the movement (e.g. with a motor) the length of the distance through which the band passes is changed: If the distance increases the storage unit will be filled, and if the distance decreases the storage unit will be emptied.

A band tensioner or tension regulation may be integrated in the band storage unit or mounted before or after it. Preferably the band tensioner is placed in front of the band storage unit, since in this way the band travels through the band storage unit with a well-defined tension. However, a band storage unit controller may also perform at least partially the band tensioner functions and regulate the band tension within a certain range. The device may comprise more than one band tensioner: for example, one that generates and/or controls the tension on the object during the banding process and a second one that generates and/or controls the tension of the band on the path through the device.

In an additional embodiment the band storage unit controller and the supply roll controller are matched with one another or they are identical. The band storage unit controller or the supply roll controller may be part of the device controller and/or synchronized with one another or otherwise matched with one another.

In another embodiment the connecting device and the supply roll controller or band storage unit controller are coordinated with one another in such a manner that upon welding of the end of a band with the beginning of a band, these overlap by less than 1 cm, especially less than or equal to 0.7 cm in length.

Bands are often supplied on supply rolls. The possibility of integrating several supply rolls in the device allows operation without interruption, since one supply roll may always be undergoing replacement while the band is being unrolled from another supply roll. Joining the band end of the band from one roll and the beginning of the band of the band from another roll reduces material consumption and accelerates operation, since in this way the band does not need to be newly introduced into the device, but instead the band from one roll passes almost without a transition into the band from the next roll, and is conducted through the device by this. Without the joint it might occur that a relatively long end piece of a band cannot be used for banding, since either it is too short to completely surround the object or it can no longer be adequately controlled. However, if the beginning of the band and band end are not connected, it is possible to prevent the surrounding of an object with a banding that has a joint region.

The transition between the two bands from different rolls is less noticeable and more conservative of materials, the shorter is the overlap area. The overlap area is the distance (measured over the length of the bands) in which the two bands overlap. Nevertheless the joint should be able to bear an adequate load. For this purpose, for example, connection methods such as welding or adhesive bonding or form-fit connection or other known joining methods for bands are suitable. In welding, the preferred method of ultrasonic welding or local heat application may be used. The connection method is preferably the same as that used in the joining device, so that the bond is essentially as strong as that produced by the joining device.

Welding preferably takes place before the band has reached the band guiding device or the lowerable band guide or the joining device and thus preferably close to the supply rolls. (Wherein the distance should be measured along the path that the band follows during operation in this case.)

In an additional embodiment the device comprises a printer unit for imprinting the band before or during the banding or strapping process.

The printer unit is preferably a thermal transfer printer.

The printer unit is preferably mounted after a band storage unit in the band travel direction and it is in particular freely accessible. "Freely accessible" means in particular that no tools need be used to reach the printer unit.

In an additional embodiment the device, aside from the printer unit, remains in its operational state, while access to the printer for maintenance work exists.

A printer unit makes it possible to imprint the banding in a custom fit and tailored to the individual object. For example, a thermal transfer printer allows application of a bar code or a matrix code. Alternatively, the bands can already be imprinted before introduction into the band storage unit. Then, however, individual imprinting requires very accurate adjustment and very exact knowledge of the objects and their sequence (if this is of importance because of objects being different from each other).

Alternatives to thermal transfer printing are, for example, ink jet methods, laser printing methods, line printing methods, needle printing methods, thermal sublimation printing, direct thermal printing or laser labeling. The selection of the printing method is based, on one hand, on the required resolution and quality of the printed image, and on the other hand, on the material, dimensions and type of the band. For example, laser printing can damage a thin band so severely that it is no longer usable. On the other hand, laser labeling may be suitable for very rough belts with irregular surfaces, while thermal transfer printing could give less satisfactory results.

The printing unit is preferably mounted to be readily accessible, since almost all printing methods comprise a consumable material such as ink or toner. Refilling this consumable material as well as work such as cleaning the print heads should be possible quickly and easily. Since any manipulation on a device can cause damage, it is advantageous to mount the printer unit such that the maintenance of the printer unit and the refilling of its consumable material can take place without having to remove or move other parts of the device. Preferably a printer unit may also be replaced or expanded with another printer unit without substantial changes having to be made on the remainder of the device. In this way, several printing methods could be used with one device.

In an additional embodiment, at least one of the drives used is realized with at least one servomotor. Preferably at least one of the servomotors can be controlled by remote access.

Preferably the at least one servomotor that drives the band or the belt can also be used as an abrasion-free brake.

The servomotor permits accurate control of its position and/or velocity and/or acceleration. Since servomotors are controllable, the control of the device can be used to precisely set the position and/or velocity and/or acceleration and, for example, adapt these to the band used, the object to be wrapped or the process status. For example it is conceivable for the method to proceed somewhat more slowly, while one band end of a roll is being connected to the beginning of the band of another roll and possibly also for the band tension to be reduced somewhat, while the joint region is still within the device.

Precise control is not necessarily of the same importance everywhere. For example, it is conceivable to regulate only the band tension or only the band velocity or only the object compression with a servomotor, but otherwise to use other drives. Naturally solutions that get by entirely without servomotors are also conceivable: For example, controllable stepping motors are a possibility, or motors that themselves are not readily controllable, but can be used in a targeted manner, or can exert only certain forces through the use of clutches and brakes are other examples. Process steps can also be synchronized and targeted forces applied with other mechanical means as well.

One possible application of a servomotor is in the acceleration and braking of the band. Since both the acceleration and braking processes can be designed such that the band does not slip substantially over a surface of high friction, the band will not be abraded. Thus neither the band nor a printed image that may be present thereon will be damaged. This type of brake also does not have any braking coating and therefore is low-maintenance.

In an additional embodiment the device comprises at least one sensor. This can preferably measure the pressure on the packet and/or the tension on the band and/or the presence of supply rolls and/or the quality of the printing and/or another property of the device, the packet and/or the band. The sensor data can preferably be read by remote access.

Sensors allow monitoring and control of the process and the device. If the device has an electronic control, it is possible to automatically integrate sensor data and adapt the control signals such that the method will proceed optimally. If the device does not have any electronic control, the sensor data can be used for adjustment of the device, e.g., by a technician.

Sensors in connection with an electronic control make it possible for the device to set itself up with regard to the monitored and controllable parameters, at least over a certain range. This can for example allow quick and spontaneous change of objects and/or band types without the device having to be precisely set up for this in advance.

If sensor data are readable by remote access, the device can be controlled remotely and, if the controller and/or the motors are also controllable by remote access, they can also be controlled remotely. This can increase the productivity and workplace safety and/or also help to optimally integrate the banding method into an existing sequence of production steps.

Typical objects for banding are packages with different contents or stacks. Items stacked are typically cardboard, e.g., collapsed cardboard boxes or papers, for example newspapers or catalogs. However, completely different objects may also be involved: Cans, packages of any desired goods, foods, medications, cables, letters, textiles, dry ice containers, etc. All these objects may be banded individually or in stacks. Naturally the objects may also lie in direct succession and be banded as stacks in this way. The height of the stack is limited by the highest level of the band guide. The width of the stack on one side may be limited by the fact that the band guide must be mounted somewhere.

Strapping is usually applied to stable objects such as outer cartons, cables, cans or construction materials such as stones, tiles and/or wood products. Likewise, newspapers and/or mixed products are strapped, sometimes together with a pallet. The possibilities for arranging the objects are the same as in the case of banding.

It is possible to use two machines according to the invention, preferably banding and/or strapping machines, simultaneously on the same object, so that two parallel bands can be wrapped around the object. It is also possible to combine a longitudinal banding and/or longitudinal strapping machine and a transverse banding and/or transverse strapping machine, although in such a case the different mechanical layouts must be carefully coordinated with one another.

The selection of the band, along with optical and esthetic viewpoints, also depends on the connection method used.

Typical bands for banding methods are between 10 and 100 mm wide and may have thicknesses of up to 50 μm. Here, bands with a width of 1-150 mm, especially 5-100 mm or 8-50 mm, are preferably used. A thickness of the bands in particular measures 50 μm-2 mm, especially 100 μm-1 mm or 150 μm-500 μm.

Typical bands for strapping processes are between 5 and 30 mm wide and have a standardized thickness of preferably between 0.1 and 1 mm and particularly preferably between 0.25 and 0.6 mm.

Typically these are plastic bands or paper bands. The plastic bands in particular consist of polymer material, preferably polypropylene (PP). However, other plastics, for example polyethylene terephthalate (PET), are also possible. Plastic bands and paper may be imprinted and/or coated. Coating can allow the use of an actually unsuitable material in a certain connection method. For example, coated paper may be ultrasonically welded.

Additional advantageous embodiments and combinations of features of the invention are evident from the following detailed description and the totality of the claims.

BRIEF DESCRIPTION OF THE FIGURES

The drawings used for explaining the exemplified embodiments show.

Basically in the figures the same parts are provided with the same reference symbols.

METHODS OF EXECUTING THE INVENTION

Figure 1:
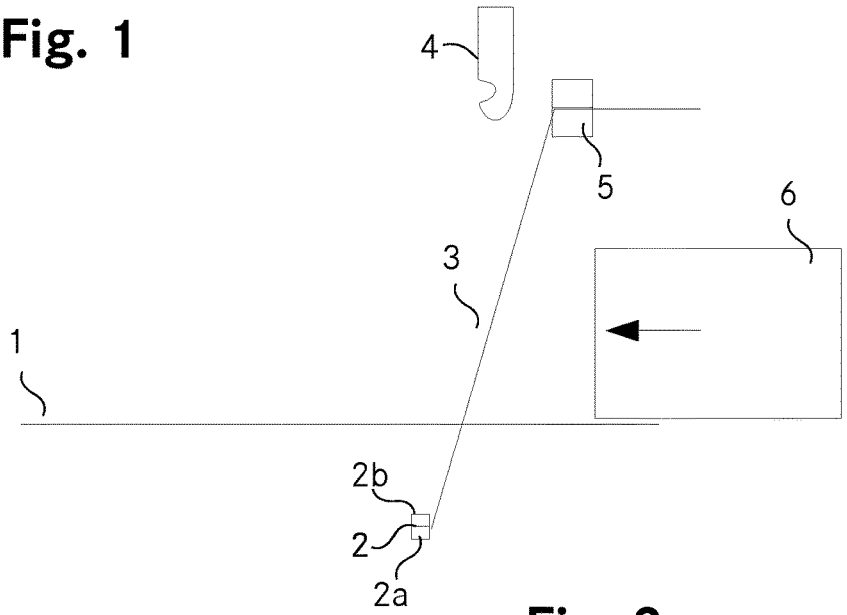
FIG. 1 Starting situation of the banding process as an example of a method for wrapping a band around an object.

FIG. 1 shows the initial situation of a banding method according to the invention as an example of a method for wrapping a band around an object. The method can also be performed analogously as a strapping method. An object 6, e.g., a stack of paper or cardboard, moves on a conveyor level 1. A band 3 is held in a rear holding device 2 lying below the conveyor level 1. From there it moves to a point in a level above the object, where in this case a band tensioner 5 is installed. In this example a band guide 4 is located without contact with the band in the horizontal direction between the band tensioner 5 and the rear holding device 2 and on a similar level as the band tensioner 5. In another embodiment, contact exists between the band guide 4 and the band 3 in this situation. If this is the case, the band guide 4 can hold the band in the level above the object. It is also possible that instead of the band tensioner 5 a deflector roller or another component that can hold the band in the level above the object 6 may be used. The band comes from a band source which is not shown and which is preferably a supply roll. From there the band is guided over the band tensioner 5, possibly over the band guide 4, to the rear holding device 2. In between, guide rollers and additional components can be used to guide and handle the band in the desired way. For example, it could also be imprinted.

The band tensioner creates or maintains a band tension lower than that which the closed, finished band loop, which in the case of banding is the banderole, shall finally have (target tension).

Figure 2:
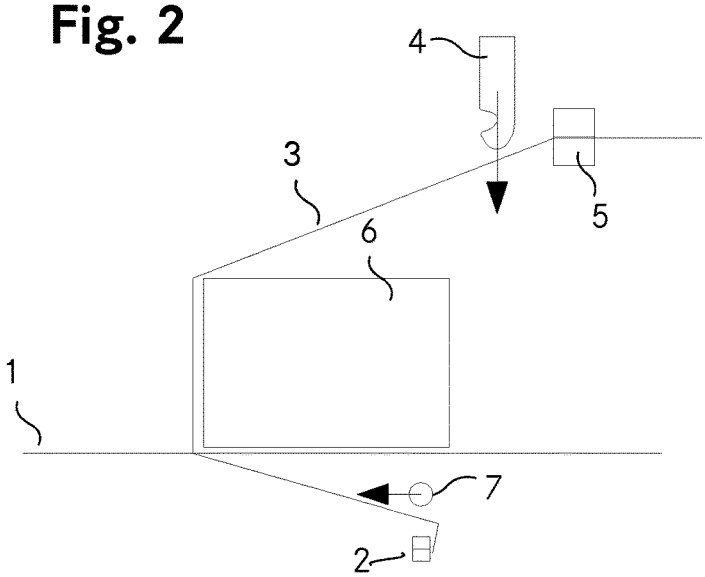
FIG. 2 Protuberance of the band due to an object

FIG. 2 shows the situation at a time shortly after the situation in FIG. 1. The object 6 has reached the band, tightened between the rear holding device 2 and the band tensioner 5, and has bulged it out because of its movement in the conveying direction. A band guiding device 7 was brought into the band plane and also moves in the conveying direction. Since the object 6 has passed the position of the band guide 4 in the horizontal direction, the band guide 4 now lowers.

Figure 3:
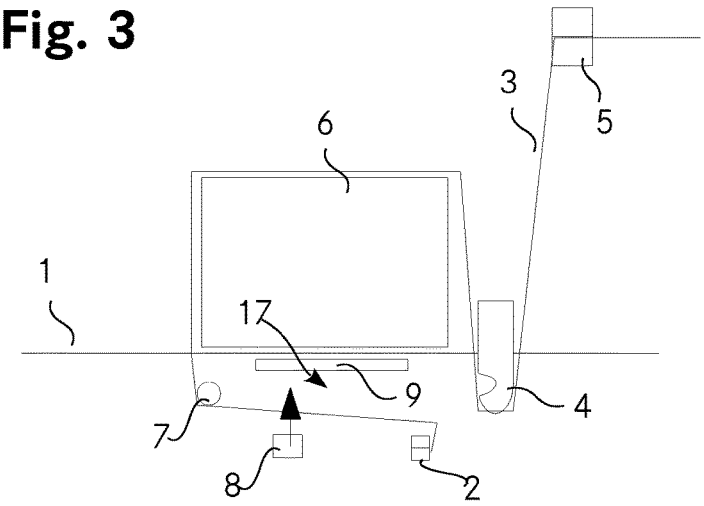
FIG. 3 Introduction of the counter-pressure plate

FIG. 3 shows the result of these movements. This is the situation at a time after that shown situation in FIG. 2. The band guide 4 has now pressed or guided the band 3 behind the object 6 below the conveyor level 1. The band guiding device 7 has guided the band beneath the conveyor level 1 such that a free space 17 has formed between the band 3 and the conveyor level 1 respectively the object 6. The counter-pressure plate 9 was introduced into this free space. After this has been done, the band guiding device 7 can be removed again. For this purpose the front holding device 8 now moves upward to clamp the band 3 tightly between itself and the counter-pressure plate 9.

While the band guide 4 presses the band below the conveyor level 1, the band tension is controlled to be the target tension or an even higher tension by the band tensioner 5.

Figure 4:
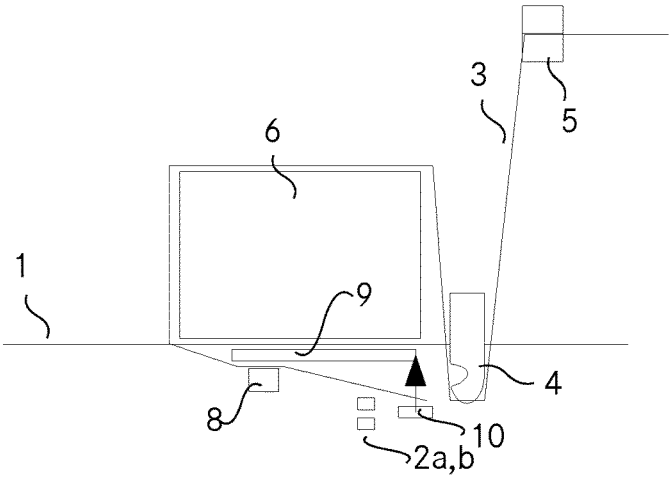
FIG. 4 Release of the beginning of the band

The situation at a later time point is shown in FIG. 4. The band 3 is held by the front holding device 8. Therefore the rear holding device 2 can release the band. Thereby, the two jaws of the rear holding device 2 divide into an upper jaw 2*b* and a lower jaw 2*a*. A band start holding device 10 moves upward and leads thereby the beginning of the band, which is free at this stage, towards the counter-pressure plate 9.

Figure 5:
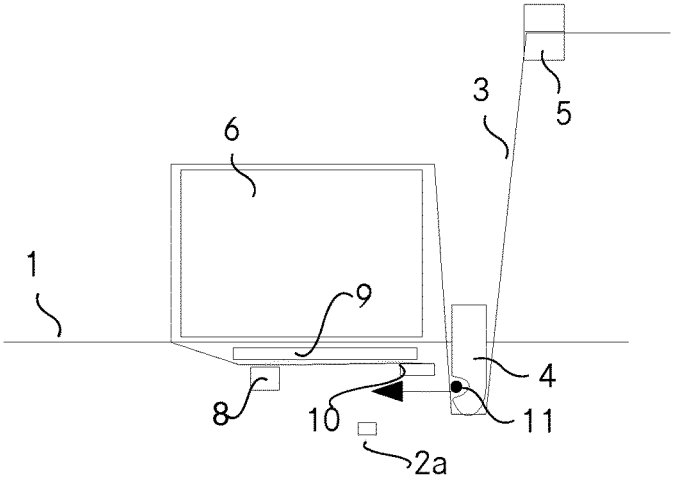
FIG. 5 Starting position of the loop puller

In FIG. 5 the band 3 is pressed against the counter-pressure plate 9 by the band start holding device 10 and the front holding device 8 at this stage. However, the band section fixed in this way is only the beginning of the band. Another part of the band travels over or through the band guide 4. In a suitable cutout of the band guide 4, a loop puller 11 is introduced, now located between the band guide 4 and the band 3. It moves in the conveying direction and thus draws the band 3 along with it. The band tension is kept at or somewhat above the high target tension value by the band tensioner 5.

Figure 6:
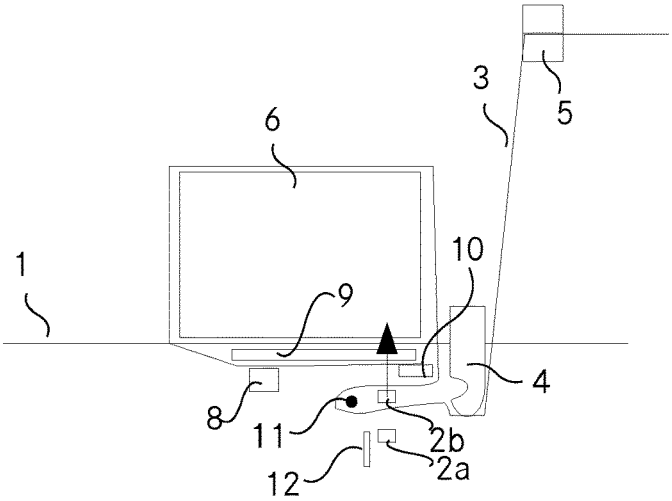
FIG. 6 Fixation and severing of the loop

FIG. 6 shows the loop formed by the movement of the loop puller 11. The upper jaw 2*b* of the rear holding device is introduced into the loop and moves upward. The lower jaw 2*a* of the rear holding device also moves upward. The band 3 is now clamped twice in the area of the loop: Once at a point at the upper side of the loop between the counter-pressure plate 9 and the upper jaw 2*b*. This is the additional holding device. A second time, the band 3 is clamped in the area of the lower side of the loop between the upper jaw 2*b* and the lower jaw 2*a*. This is the rear holding device. A severing device 12, which may be a knife, for example, severs the band shortly in front of the rear holding device. ("Front" and "back" are defined relative to the conveying direction).

Figure 7:
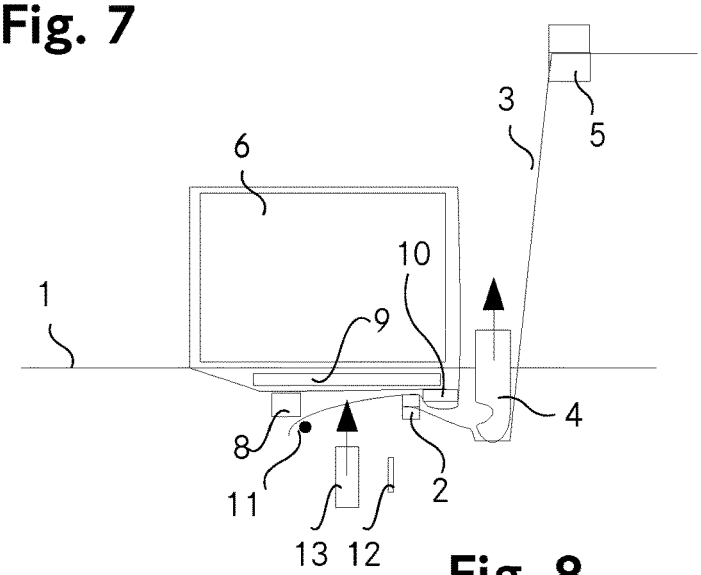
FIG. 7 Spreading out of the loop

The following steps are shown in FIG. 7. After the loop was opened by the severing of the band 3, the loop puller 11 moves on in the conveying direction and thus stretches out the loop. A joining device 13 is brought to the band 3 in the area of the counter-pressure plate 9. The band 3 now overlaps with itself in this area. The band guide 4 can be raised again at this stage and returns to the position in a level above the object 6. At this stage, the band tension is reduced again by the band tensioner 5.

Figure 8:
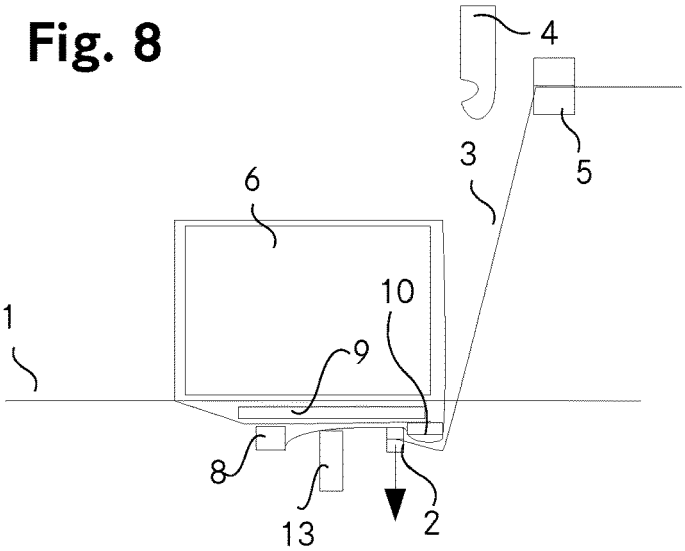
FIG. 8 Connecting

In FIG. 8 the connection between the overlapping band sections is just being produced by the joining device 13. The band 3 no longer needs to be held against the counter-pressure plate 9 and therefore the front holding device 8 releases it, the band start holding device 10 and the rear holding device 2 move, both jaws 2*a* and 2*b* pressed together and thereby holding the new beginning of the band, away from the counter-pressure plate 9, which releases the additional holding device. The counter-pressure plate 9 can be removed in the following, too.

Figure 9:
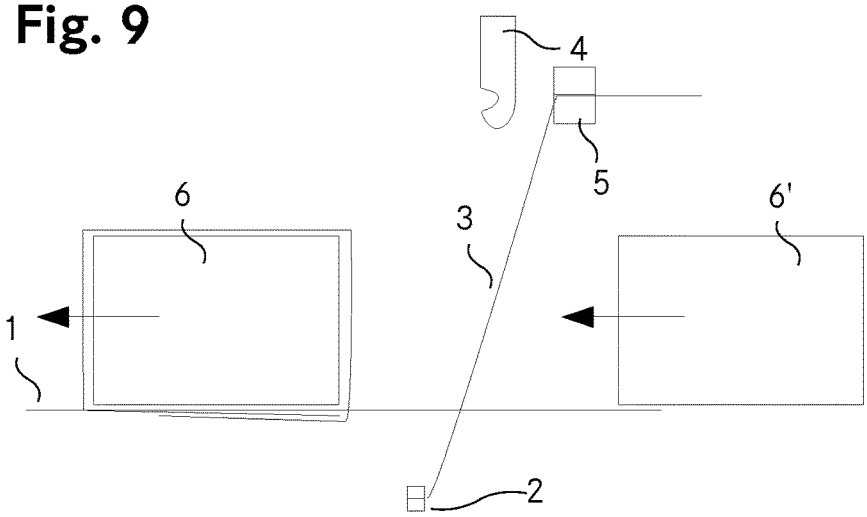
FIG. 9 Release and transport away of the object

FIG. 9 shows the result: The object 6 with the band wrapped around it, i.e. the banded object in the case of banding, is transported away. Here, this takes place in the conveying direction, too. The mechanism for wrapping a band around an object (e.g., a banding or strapping mechanism) is in the same configuration as in FIG. 1. An additional object 6' moves in the conveying direction toward the tightened band 3 and the process can start from the beginning.

Figure 10:
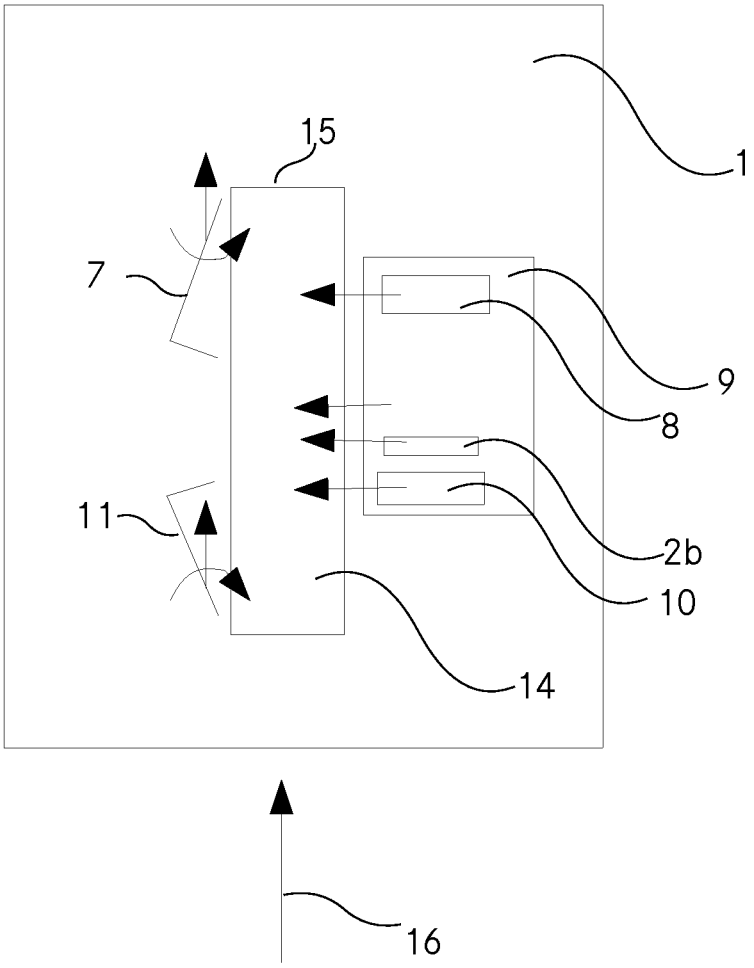
FIG. 10 Possible resting positions of various components

FIG. 10 shows possible resting positions of the components, which move into the band plane and which are removed from it again over the course of the process. A "resting position" here is defined as the position in which the components are not performing any task or not their primary task. Naturally other components may be making such movements. FIG. 10 is a sketch of the top view on the conveyor level 1. The conveyor level 1 and all components shown are illustrated as transparent. Only their outlines are shown.

The conveyor level 1 has an opening 14, and this has a front edge 15. The conveying direction 16, which defines the direction for "front" and "back," is shown by an arrow. On the right-hand side of the opening 14, the counter-pressure plate 9 is shown in its resting position. Below the counter-pressure plate 9, parts of the different holding devices are located: The front holding device 8, the upper jaw of the rear holding device 2*b* and the band start holding device 10.

During the process, all of these components are never in the resting position simultaneously: The upper jaw of the rear holding device 2*b* is moved into a situation in the resting position in which at least the front holding device 8 and the counter-pressure plate 9 are being used. At the time when the counter-pressure plate 9 is removed, the upper jaw of the rear holding device 2*b* is again in use for holding the next beginning of the band.

In this embodiment, on the left-hand side of the opening, the band guiding device 7 and the loop puller 11 are shown as hooks. These can be brought into the band plane by a pivoting movement and then pushed or pulled in the conveying direction.

Naturally, it does not matter which of the components is arranged on which side of the opening. Also, the sizes of the objects and their relationships are selected only for purposes of illustration. It is only necessary to make sure that the various holding devices are suitably arranged, so that the counter-pressure plate can serve as the complement to a clamp if this solution is desired.

Figure 11:
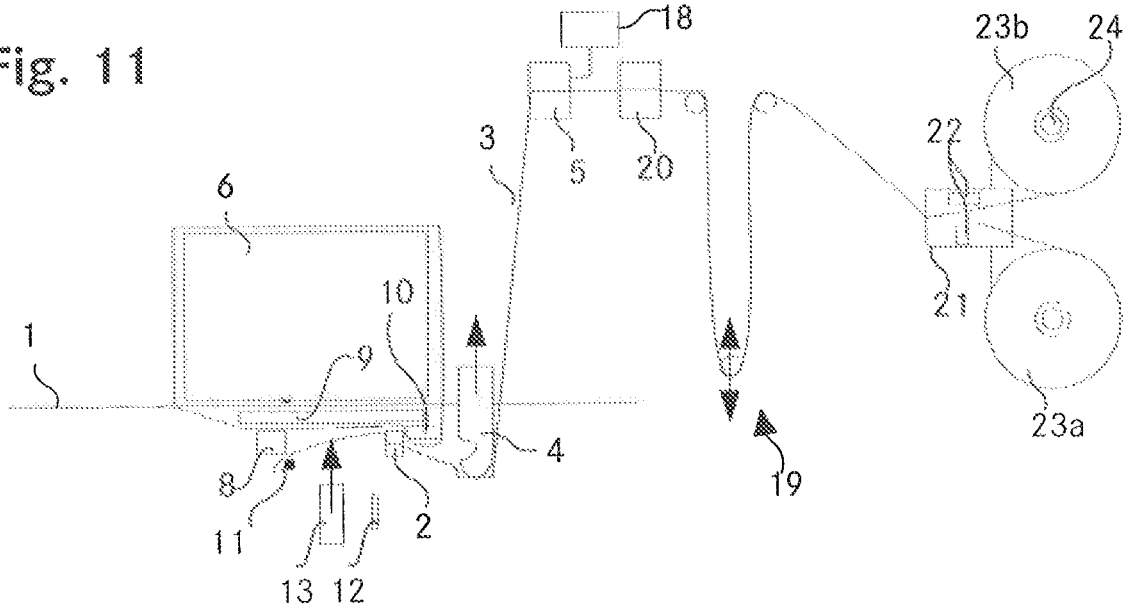
FIG. 11 A device for wrapping a band around at least one object

FIG. 11 depicts a device for wrapping a band around at least one object.

The device comprises two supply rolls 23*a*, 23*b* for bands which are coordinated with one another by a supply roll controller 21 in such a manner that a supply roll 23*a*, 23*b* can be changed in each case while bands are being drawn off of another supply roll 23*b*, 23*a*. The device comprises a band storage unit 19 which makes it possible for the banding process to continue running for a certain time without braking or only slowing, without the band on the other side of the band storage unit 19 moving because of the banding process. The band storage unit 19 is band guidance over three deflecting rollers, one of which is movable relative to the other two. The device comprises a welding device 22, which is an embodiment of a connecting device, with which a band end of one band on a first supply roll 23*a* can be connected to the beginning of a band on a second supply roll 23*b*.

The device comprises a printer unit 20 for imprinting the band before and/or during the banding or strapping process. The printer unit 20 is preferably mounted after a band storage unit in the band travel direction.

The band tensioner 5 comprises at least two elements between which the band moves. One of the elements is a roller that rotates at a certain speed. To produce and control the desired speed, a special motor is used. It is a servomotor 18 that drives the band.

The device comprises a sensor 24. It can measure the presence of supply rolls.

However, the method described in the preceding and the devices shown are to be understood as merely illustrative examples, which can be modified as needed within the scope of the present invention.

For example, it is possible that the band guiding device 7 will initially guide the band 3 further in the conveying direction than the object 6 and the object 6 will only reach the position shown in FIG. 3 at a later time.

The band guide 4 can already occupy a lower position at an earlier time. However, it should not collide with the object 6. The band guiding device 7 can be removed before or after pressing on the front holding device 8.

The front holding device 8 need not necessarily use the counter-pressure plate 9 as a second clamping jaw, but could have a separate, second clamping jaw.

The band holding device 10 may also be dispensed with. In this case the path along which the loop puller 11 moves can be adapted sufficiently.

The band guide 11 can be designed such that the loop starts and ends at it. For this purpose the band 3 may be held on the band guide 4 with a suitable device. Alternatively, the loop may start at the band guide 4 and end at the corner of the object 6, the edge of the counter-pressure plate 9 or the edge of the band start holding device 10. The preferred solution is for the corner of the object 6 to delimit the loop, since in this case the band 3 will lie tightly against the object 6.

In the embodiment shown, the additional holding device is formed by the upper jaw 2*b* of the rear holding device and the counter-pressure plate 9. However, the additional holding device may also consist of two jaws of its own or of one jaw and the counter-pressure plate 9.

The placement of the band tensioner 5 is also variable. A deflecting roller can hold the band in the place above the object shown here. However, it is also possible for the band 3 to be guided through the band guide 4 in such a way that the band guide 4 can hold the band 3 up without further aids. The band tension could then be placed at any point whatsoever between the band source and the band guide 4. The band tensioner may also be integrated into the band source in that, for example, it controls the rotation of a supply roll.

The device for introducing a counter-pressure plate according to the invention is shown in FIG. 3. Then in FIG. 4 it is clear how the band guiding device 7 fulfills its task of enabling the introduction of a counter-pressure plate 9. The band tensioner 5 and the band guide 4 are not part of this device, nor are the band 3 nor the object 6.

The invention claimed is:

1. A device for introducing a counter-pressure plate between a band and a conveyor level in a banding and/or strapping machine, comprising:

a) A rear holding device which can hold a beginning of the band and b) the conveyor level with an opening which is located above the rear holding device and on which an object can be moved in a conveying direction, wherein in the movement of the object on the conveyor level in the conveying direction the band, the beginning of which is held by the rear holding device and which projects through the opening into the conveyor level is drawn in the conveying direction through the opening in the conveyor level, wherein c) a band guiding device is present, which is movable in the conveying direction in a region between the band and the conveyor level and positions or guides the band beneath the conveyor level, creating a free space for inserting the counter-pressure plate between the band and conveyor level.

2. A device for wrapping bands around an object, comprising the following parts:

a) A device for introducing a counter-pressure plate according to claim 1 b) A lowerable band guide which can be located in a level above the objects and which may be located below a conveying level and in both positions can guide the band and in a starting position tensions the band between the lowerable band guide in the level above the objects and the rear holding device c) A counter-pressure plate that can be brought below the conveyor level between the band and the underside of the object and removed again d) A front holding device that can fix the band at a point in front of the rear holding device e) A loop puller that can pull the band from the band guide, in the position beneath the conveyor level, starting in the conveying direction, into a loop f) A severing device that can sever the band, preferably directly behind the rear holding device, and g) A joining device that can connect the band to the band in an overlapping region.

3. The device for wrapping a band around at least one object according to claim 2, which comprises also a band tensioner which regulates the band tension.

4. The device for wrapping a band around at least one object according to claim 3, wherein the band tensioner is electrically controllable.

5. The device for wrapping a band around at least one object according to claim 2, wherein the device comprises several supply rolls for bands.

6. The device for wrapping a band around at least one object according to claim 5, wherein the supply rolls are coordinated with one another by a supply roll controller in such a manner that a supply roll can be changed in each case while bands are being drawn off of another supply roll.

7. The device for wrapping a band around at least one object according to claim 6, wherein the supply roll controller and the band storage unit controller are coordinated with one another or integrated into a mutual control unit.

8. The device for wrapping a band around at least one object according to claim 6, wherein the connecting device and the supply roll controller are coordinated with one another in such a manner that upon welding of one end of a band with the beginning of a band, the one end of a band and the beginning of a band overlap by less than 1 cm.

9. The device for wrapping a band around at least one object according to claim 2, which comprises a band storage unit which allows the banding process to continue running for a certain time without braking or only slowing, without the band on the other side of the band storage unit moving because of the banding process.

10. The device for wrapping a band around at least one object according to claim 9, wherein the band storage unit is controlled by a band storage unit controller.

11. The device for wrapping a band around at least one object according to claim 2, which comprises a connecting device with which a band end of one band on a first supply roll can be connected to the beginning of a band on a second supply roll.

12. The device for wrapping a band around at least one object according to claim 11, wherein the connecting device involves a welding device.

13. The device for wrapping a band around at least one object according to claim 2, wherein the device comprises a printer unit for imprinting the band before and/or during the banding or strapping process, wherein the printer unit is preferably a thermal transfer printer.

14. The device for wrapping a band around at least one object according to claim 13, wherein the printer unit is mounted after a band storage unit in a band movement direction.

15. The device for wrapping a band around at least one object according to claim 14, wherein the printer unit is freely accessible.

16. The device for wrapping a band around at least one object according to claim 2, wherein at least one of the drives used is realized as at least one servomotor.

17. The device for wrapping a band around at least one object according to claim 16, wherein at least one servomotor that drives the band can also be used as an abrasion-free brake.

18. The device for wrapping a band around at least one object according to claim 16, wherein the servomotor can be controlled by remote access.

19. The device for wrapping a band around at least one object according to claim 2, wherein the device comprises at least one sensor.

20. The device for wrapping a band around at least one object according to claim 19, wherein the sensor data can be read by remote access.

21. The device for wrapping a band around at least one object according to claim 19, wherein the sensor can measure the pressure on the packets and/or the tension on the band and/or the presence of supply rolls and/or the quality of the imprinting and/or another property of the device, the packet and/or the band.

* * * * *